US006324858B1

(12) United States Patent
Holden

(10) Patent No.: US 6,324,858 B1
(45) Date of Patent: Dec. 4, 2001

(54) MOTOR TEMPERATURE CONTROL

(75) Inventor: Steven J. Holden, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/200,816

(22) Filed: Nov. 27, 1998

(51) Int. Cl.[7] ..... F25B 41/00; F25B 1/00

(52) U.S. Cl. ..... 62/211; 62/230; 310/53; 318/473; 417/423.8

(58) Field of Search ..... 62/230, 211, 505; 417/423.8; 310/16, 53; 318/473

(56) References Cited

U.S. PATENT DOCUMENTS 3,555,356 * 1/1971 Kaiser ..... 318/473 X
4,626,753 * 12/1986 Letterman ..... 318/473 X
5,298,842 * 3/1994 Vanek et al. ..... 318/473
5,475,985 12/1995 Heinrichs et al. ..... 62/117
5,582,022 12/1996 Heinrichs et al. ..... 62/175
6,041,605 * 3/2000 Heinrichs ..... 62/505 X

* cited by examiner

*Primary Examiner*—William Wayner

(57) ABSTRACT

The motor power consumption and motor winding temperature are monitored and, responsive thereto, the flow of refrigerant to the motor is controlled so as to control the temperature of the motor. The motor power consumption in the primary control input because it anticipates cooling requirements whereas the motor temperature indicates current cooling requirements. The cooling flow may be provided in an on-off manner or there may be a constant flow portion with an on-off parallel cooling flow path.

6 Claims, 3 Drawing Sheets

MOTOR TEMPERATURE CONTROL

BACKGROUND OF THE INVENTION

Electric motors are driven by supplying electricity to the motor windings. This results in the heating of the windings and associated motor structure due to losses in driving the motor. While motors are designed to operate at an elevated temperature, conventionally, motors are cooled responsive the motor windings reaching a predetermined temperature. For hermetic and semi-hermetic refrigerant compressors, cooling is achieved by causing refrigerant gas or liquid to flow through/over the motor structure before being supplied to the compressor with the suction or mid-stage pressure gas. Since the motor efficiency and equipment size requirements dictate limited flow path availability, the amount of cooling flow is somewhat limited. The motor structure, however, represents such a large thermal mass that the result is that there can be a significant time period before the motor cooling flow achieves the desired cooling effect to return the motor temperature to the desired level. During this time period the windings can experience a large deviation from the desired operating temperature.

SUMMARY OF THE INVENTION

The present invention uses the motor load to anticipate changes in motor cooling requirements and uses it as the primary process variable. Because of the time lag between changes in the motor load and a perceived temperature change, better motor temperature control is achieved than would be the case where cooling is responsive to motor temperature fluctuations from a set point. The motor winding temperature is used as a secondary variable to make minor corrections to the process output, i.e. the motor cooling flow. This mode of operation reduces operation at elevated temperatures above the design temperature and reduces the cooling requirement when the motor load has dropped but the motor is still at an elevated temperature due to the time lag in changes.

It is an object of this invention to reduce the time lag in a compressor motor cooling system.

It is another object of this invention to provide better motor temperature control by using motor load to anticipate changes in motor cooling requirements. These objects, and others as will become apparent hereinafter, are accomplished by the present invention.

Basically, motor power consumption and motor winding temperature are monitored and, responsive thereto, the flow of refrigerant to the motor is controlled so as to control the temperature of the motor.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
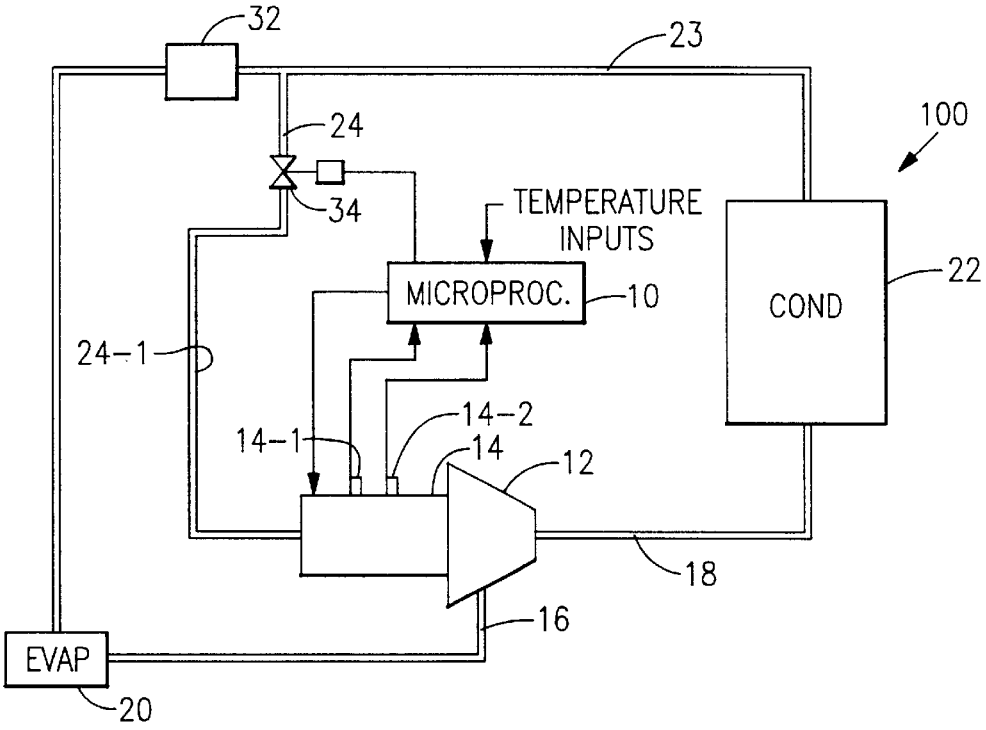
FIG. 1 is a schematic representation of a liquid cooled single-valve, non-economized system employing the present invention.

In the Figures, hermetic or semi-hermetic compressor 12 is driven by motor 14 and is fluidly connected to suction line 16 and discharge line 18 which are connected, respectively, to the evaporator 20 and condenser 22 of the refrigeration system. An expansion device 32 which may be a thermostatic or an electronic expansion valve is located between condenser 22 and evaporator 20. Microprocessor 10 receives temperature (air or water) inputs and controls the refrigeration system responsive thereto. According to the teachings of the present invention, microprocessor 10 receives inputs representative of the power input to motor 14 and the temperature of the windings of motor 14. Additionally, since microprocessor 10 controls motor 14 responsive to demand, control can be responsive to the approaching of demand satisfaction, for example.

The present invention controls the cooling of motor 14 responsive to the power draw of motor 14 and the temperature of the windings of motor 14 by supplying liquid or gaseous refrigerant to motor 14 by modifying the basic system described above as in one of the specific manners described below.

In FIG. 1, numeral 100 designates the basic refrigeration system described above and further includes branch refrigerant line 24 extending from liquid refrigerant line 23 from a point upstream of expansion device 32 and extending into motor 14. Solenoid valve 34 is located in line 24 and is controlled by microprocessor 10 responsive to motor power consumption sensed by power transducer 14-1 and to motor winding temperature sensed by temperature sensor 14-2. Solenoid valve 34 meters the flow of liquid refrigerant to motor 14 via line 24 in order to keep motor 14 in the designed operating temperature range. The liquid refrigerant is metered through an expansion orifice and solenoid valve combination to reduce its saturation temperature, thus changing the refrigerant from the liquid state to a two-phase mixture of liquid and gas in line 24-1. There is no flow of refrigerant to motor 14 via line 24 when valve 34 is closed. The duty cycle of solenoid valve 34 is common to the embodiments of FIGS. 1 through 5 and is described below.

Figure 2:
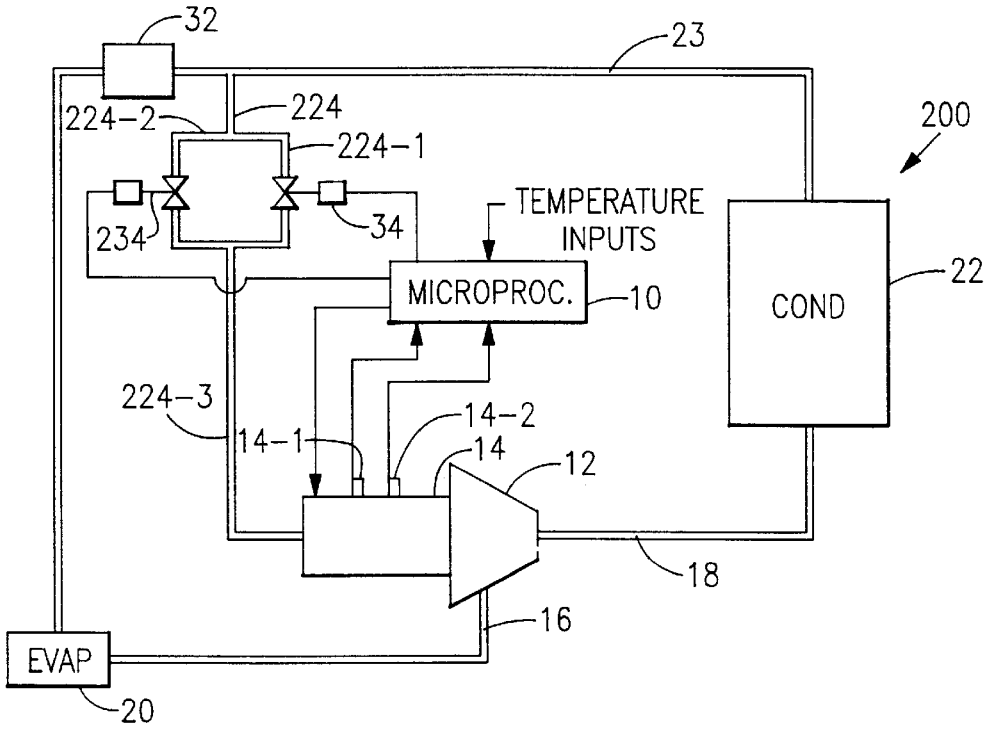
FIG. 2 is a schematic representation of a liquid cooled two-valve, non-economized system employing the present invention.

In FIG. 2, the numeral 200 designates the basic refrigeration system described above and further includes branch liquid line 224 extending from liquid refrigerant line 23 from a point upstream of expansion device 32. Line 224 branches into parallel branch liquid lines 224-1 and 224-2 which recombine into two-phase, liquid and gas, line 224-3 which extends into motor 14. Solenoid valve 234 is in line 224-2 and is opened by microprocessor 10 whenever compressor 12 is operating so that there is a constant flow of liquid refrigerant to motor 14 via valve 234. This constant supply of refrigerant is intended to provide a minimum amount of cooling for all load conditions. Valve 34 is sized to provide additional cooling for higher load conditions. Accordingly, valve 234 is open whenever compressor 12 is operating and valve 34 is duty cycled as described below.

Figure 3:
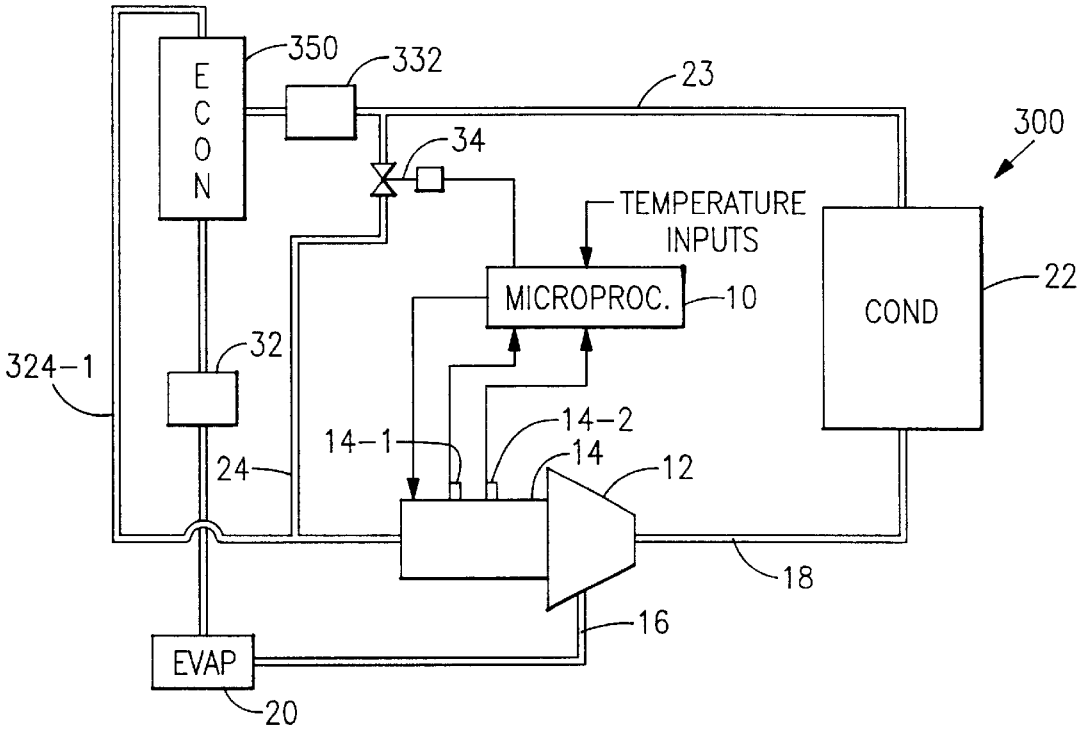
FIG. 3 is a schematic representation of a flashtank economizer system employing the present invention.

In FIG. 3, the numeral 300 designates a refrigeration system that is the same as refrigeration system 100 of FIG. 1 with the addition of flashtank economizer 350 downstream of expansion device 332 and upstream of expansion device 32. In a flashtank economizer, a portion of the refrigerant is evaporated in passing through expansion device 332 and is supplied via line 324-1 and line 24 to motor 14 as saturated flash vapor from the flashtank of economizer 350. The saturated flash vapor provides a constant supply of refrigerant flow to motor 14. Additional two-phase refrigerant is supplied to the motor 14, as required, via line 24 and valve 34 which is duty cycled as described below.

Figure 4:
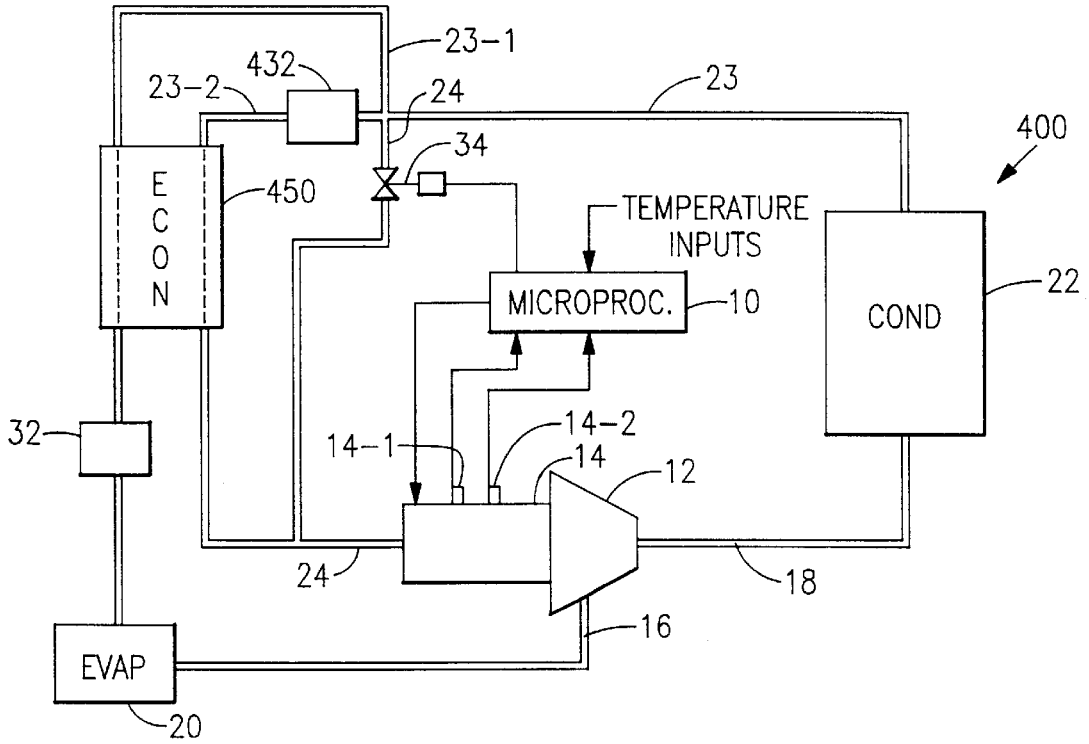
FIG. 4 is a schematic representation of a direct expansion economizer system employing the present invention.

In FIG. 4, the numeral 400 designates a refrigeration system that differs from refrigeration system 300 of FIG. 3 in employing a direct expansion economizer rather than a flashtank economizer. In this system, liquid refrigerant line 23 branches into lines 23-1 and 23-2 which are supplied to economizer 450. The flow in line 23-1 serially passes through economizer 450 where it is further cooled, expansion device 32 and evaporator 20. The flow in line 23-2 serially passes through expansion device 432, economizer 450 where it changes state and further cools the flow in line 23-1, leaving economizer 450 with some degree of superheat and is supplied to motor 14 via line 24. This constant supply of gaseous refrigerant from economizer 450 will be supplemented by liquid refrigerant supplied to motor 14, as required, via valve 34 which is duty cycled as described below.

Figure 5:
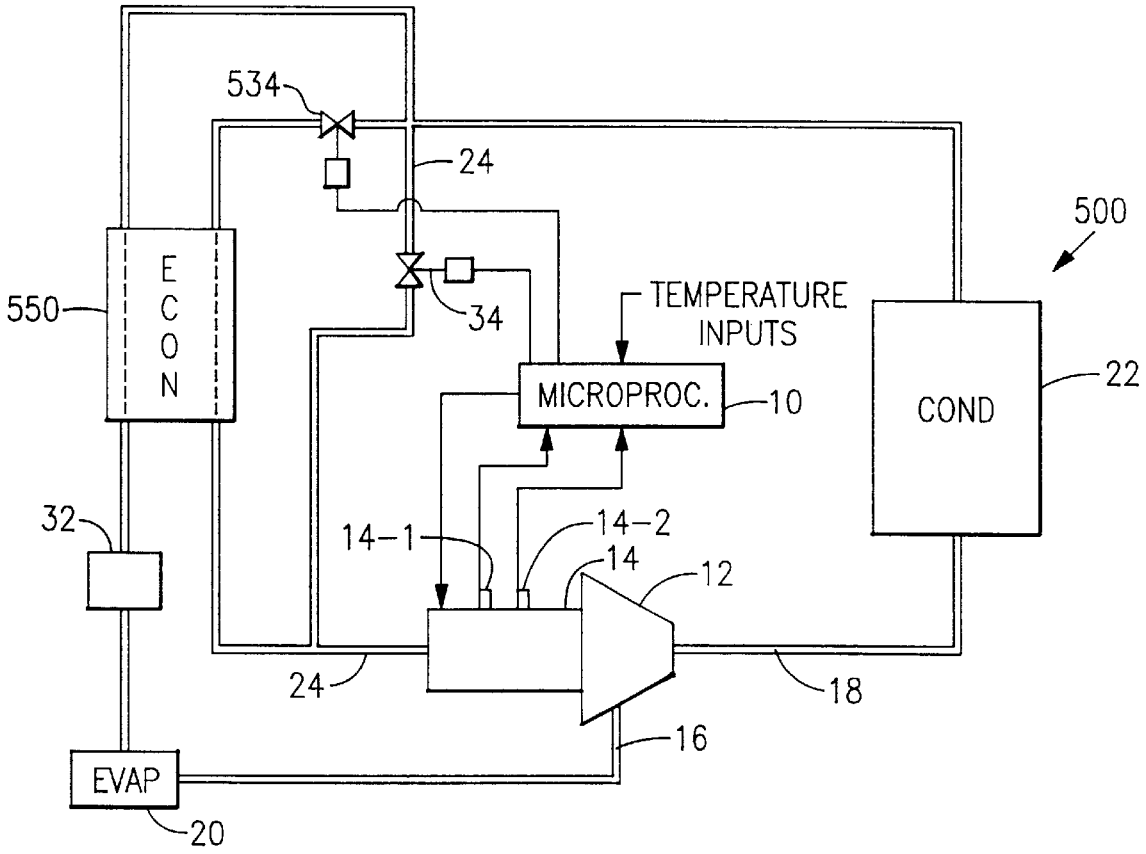
FIG. 5 is a schematic representation of liquid cooled two-valve economized system.

In FIG. 5, the numeral 500 designates a refrigeration system that differs from refrigeration system 400 of FIG. 4 in replacing expansion device 432 with solenoid 534 upstream of economizer 550. Solenoid 534 is open whenever compressor 12 is operating and is sized to provide the correct amount of cooling flow at the nominal operating condition. Valve 34 is sized to provide the correct amount of flow at the maximum load condition and is duty cycled as described below.

In each of refrigeration systems 100 through 500 valve 34 is controlled by microprocessor 10 responsive to motor power consumption sensed by power transducer 14-1 and to motor winding temperature sensed by temperature sensor 14-2. Because valve 34 is capable of supplying a sufficient amount of liquid refrigerant for cooling at maximum load, it is duty cycled to control the cooling flow when the cooling requirements are intermediate those of no/minimal and maximum cooling.

The duty cycle of the valve 34 is determined primarily by the operating load of the motor 14 sensed by power transducer 14-1 and is then corrected based on the motor winding temperature sensed by temperature sensor 14-2. The efficiency of the motor 14 is a specified variable. The motor cooling load can be approximated for any operating condition based on the power draw of the motor 14 sensed by power transducer 14-1 and the motor efficiency as shown in (1)

$$Q_{motor}=(1-\eta_{motor})\times kW_{motor} \quad (1)$$

where:

$Q_{motor}$ is the estimated cooling requirement for the motor $\eta_{motor}$ is the motor efficiency $kW_{motor}$ is the motor power consumption To determine the primary load factor of the duty cycle, the load is then compared to the maximum load condition, and the constant cooling that is provided by either the economizer gas from economizers 350, 450, or 550 or valve 234, as shown in (2).

$$LoadFactor=\frac{(Q_{motor}-Q_{constant\ flow})}{(Q_{\max\ load}-Q_{constant\ flow})} \quad (2)$$

where:

$Q_{motor}$ is the estimated cooling requirement for the motor $Q_{constant\ flow}$ is the constant flow cooling that is available $Q_{max\ load}$ is the cooling requirement at maximum load Since the embodiment of FIG. 1 has no constant cooling flow, $Q_{constant\ flow}$, equation 2 reduces to $$LoadFactor=\frac{(Q_{motor})}{(Q_{\max\ load})}$$

The size (capacity ) of valve 34 is then selected such that the Load Factor=1 at the maximum load condition. Accordingly, in the FIG. 1 embodiment, valve 34 is sized to provide the maximum required cooling flow. For the embodiments of FIGS. 2 to 5, after the Load Factor is determined according to equation 2, the size (capacity) of valve 34 is then selected such that the Load Factor=1 at the maximum load condition. The Load Factor of the valve 34 then decreases at lower load conditions until the motor cooling requirement no longer exists in the FIG. 1 embodiment or falls below the cooling that is provided by the constant flow of either the economizer gas from economizers 350, 450, or 550 or valve 234 liquid refrigerant. The Load Factor provides the coarse control of the motor winding temperature.

The winding temperature is more finely controlled by adjusting the Load Factor according to the actual winding temperature. This correction is intended to extend the duration of the overall duty cycle when the winding temperature is higher than set point and to decrease it when the winding temperature is under set point. The temperature set point is given by the following equation (3):

$$\text{TemperatureFactor}=(T_{winding}-T_{control\ point})\times\text{Gain} \quad (3)$$

where:

$T_{winding}$ is the actual motor winding temperature $T_{control\ point}$ is the desired winding operating temperature Gain is a factor to modify the sensitivity of this correction The Duty Cycle of the valve is then determined by adding the Load and Temperature Factors, as shown below. The Duty Cycle is limited to the range from zero to one, zero meaning the valve does not open, and one meaning the valve remains open all the time.

$$\text{Duty cycle}=\text{LoadFactor}+\text{TemperatureFactor}$$

$$DutyCycle=\left[\frac{(((1-\eta_{motor})\times kW_{motor})-Q_{constant\ flow})}{(Q_{\max\ load}-Q_{constant\ flow})}\right]+[(T_{winding}-T_{control\ point})\times Gain]$$

Although preferred embodiments of the present invention have been illustrated and described, other changes will occur to those skilled in the art. It is therefore intended that the present invention is to be limited only by the scope of the appended claims.

What is claimed is:

1. In a closed refrigeration system serially including a compressor driven by a motor, a condenser, an expansion device, and an evaporator, with a liquid refrigerant line connecting said condenser and said expansion device, means for controlling the temperature of said motor driving said compressor comprising:

means for sensing a parameter indicative of electrical power supplied to said motor for driving said compressor;

means for sensing a parameter indicative of the temperature of said motor;

a first fluid path connecting said liquid refrigerant line and said motor;

means for controlling flow in said first fluid path responsive to said parameter indicative of electrical power supplied and responsive to said parameter indicative of the temperature of said motor whereby the temperature of said motor is controlled.

2. In a closed refrigeration system serially including a compressor driven by a motor, a condenser, an expansion device, an evaporator, with a liquid refrigerant line connecting said condenser and said expansion device, means for controlling the temperature of said motor driving said compressor comprising:

means for sensing a parameter indicative of electrical power supplied to said motor for driving said compressor;

means for sensing a parameter indicative of electrical power supplied to said motor for driving said compressor;

a first fluid path connecting said liquid refrigerant line and said motor;

a second fluid path connected to said motor at least partially in parallel with said first fluid path and providing a constant flow of refrigerant to said motor for cooling;

means for controlling flow in said first fluid path responsive to said parameter indicative of the temperature of said motor whereby the temperature of said motor is controlled.

3. The means for controlling the temperature of said motor of claim 2 wherein said means for controlling flow in said first fluid path is responsive to a duty cycle limited to a range of zero corresponding to no flow and one corresponding to full flow where:

$$\text{DutyCycle}=\text{LoadFactor}+\text{TemperatureFactor}$$

$$LoadFactor=\frac{(Q_{motor}-Q_{constant\ flow})}{(Q_{\max\ load}-Q_{constant\ flow})}$$

where:

$Q_{motor}$ is the estimated cooling requirement for the motor $Q_{constant\ flow}$ is the constant flow cooling that is available $Q_{max\ load}$ is the cooling requirement at maximum load $$\text{TemperatureFactor}=(T_{winding}-T_{control\ point})\times\text{Gain}$$

where:

$T_{winding}$ is the actual motor winding temperature $T_{control\ point}$ is the desired winding operating temperature Gain is a factor to modify the sensitivity of this correction.

4. The means for controlling the temperature of said motor of claim 3 wherein said second flow path includes an economizer.

5. The means for controlling the temperature of said motor of claim 3 wherein said second flow path connects said liquid refrigerant line and said motor.

6. In a close refrigeration system serially including a compressor driven by a motor, a condenser, an expansion device, an evaporator, with a liquid refrigerant line connecting said condenser and said expansion device, means for controlling the temperature of said motor driving said compressor comprising:

means for sensing a parameter indicative of electrical power supplied to said motor for driving said compressor;

means for sensing a parameter indicative of electrical power supplied to said motor for driving said compressor;

a first fluid path connecting said liquid refrigerant line and said motor:

means for controlling flow in said first fluid path responsive to said parameter indicative of the temperature of said motor whereby the temperature of said motor is controlled, wherein said means for controlling flow in said first fluid path is responsive to a duty cycle limited to a range of zero corresponding to no flow and one corresponding to full flow where:

$$\text{DutyCycle}=\text{LoadFactor}+\text{TemperatureFactor}$$

$$LoadFactor=\frac{(Q_{motor})}{(Q_{\max\ load})}$$

where:

$Q_{motor}$ is the estimated cooling requirement for the motor $Q_{max\ load}$ is the cooling requirement at maximum load $$\text{TemperatureFactor}=(T_{winding}-T_{control\ point})\times\text{Gain}$$

where:

$T_{winding}$ is the actual motor winding temperature $T_{control\ point}$ is the desired winding operating temperature Gain is a factor to modify the sensitivity of this correction.

* * * * *